US010546684B2

(12) United States Patent
Huang et al.

(10) Patent No.: US 10,546,684 B2
(45) Date of Patent: Jan. 28, 2020

(54) INTEGRALLY-FORMED INDUCTOR

(71) Applicant: CYNTEC CO., LTD., Hsinchu (TW)

(72) Inventors: Yi-Min Huang, Hsinchu (TW); Chih-Siang Chuang, Hsinchu (TW); Yung-Cheng Chang, Hsinchu (TW)

(73) Assignee: CYNTEC CO., LTD, Hsinchu (TW)

( * ) Notice: Subject to any disclaimer, the term of this patent is extended or adjusted under 35 U.S.C. 154(b) by 21 days.

(21) Appl. No.: 14/830,735

(22) Filed: Aug. 20, 2015

(65) Prior Publication Data

US 2016/0055954 A1 Feb. 25, 2016

Related U.S. Application Data

(60) Provisional application No. 62/039,936, filed on Aug. 21, 2014.

(51) Int. Cl.
*H01F 27/29* (2006.01)
*H01F 17/00* (2006.01)

(52) U.S. Cl.
CPC ..... *H01F 27/292* (2013.01)

(58) Field of Classification Search
CPC .. H01F 17/06; H01F 27/292; H01F 2017/065; H01F 2017/0093
USPC ..... 336/83
See application file for complete search history.

(56) References Cited

U.S. PATENT DOCUMENTS

2004/0189430 A1* 9/2004 Matsutani ..... H01F 27/292 336/83
2005/0219027 A1* 10/2005 Satoh ..... A61B 8/08 336/83
2006/0038651 A1* 2/2006 Mizushima ..... H01F 17/04 336/83
2006/0049907 A1* 3/2006 Liu ..... H01F 17/04 336/200
2009/0085703 A1* 4/2009 Liu ..... H01F 17/04 336/192
2009/0128275 A1* 5/2009 Yagasaki ..... H01F 17/04 336/83
2010/0085139 A1* 4/2010 Yan ..... H01F 17/04 336/221
2010/0182114 A1* 7/2010 Huang ..... H01F 17/04 336/83
2010/0253463 A1* 10/2010 Shimomura ..... H01F 17/04 336/200
2010/0289609 A1* 11/2010 Liao ..... H01F 17/04 336/221
2013/0057375 A1* 3/2013 Ankyu ..... H01F 17/04 336/83

(Continued)

*Primary Examiner* — Elvin G Enad
*Assistant Examiner* — Malcolm Barnes
(74) *Attorney, Agent, or Firm* — Min-Lee Teng; Litron Patent & Trademark Office

(57) ABSTRACT

An inductive component is disclosed, the inductive component comprising: a metal structure, the metal structure comprising a conductor wire and a lead frame, wherein the lead frame and the conductor wire are integrally formed, wherein the lead frame comprises a first part and a second part space spaced apart from the first part, wherein a contiguous metal path is formed from the first part of the lead frame to the second part of the lead frame via the conductor wire; a magnetic body encapsulating the conductor wire, and a first portion of the first part and a second portion of the second part of the lead frame adjacent to the conductor wire.

11 Claims, 12 Drawing Sheets

(56) References Cited

U.S. PATENT DOCUMENTS

2014/0266555 A1* 9/2014 Krishnamoorthy ... H01F 27/292
336/216

* cited by examiner

INTEGRALLY-FORMED INDUCTOR

CROSS-REFERENCES TO RELATED APPLICATIONS

This application claims the benefit of U.S. Provisional Patent Application No. 62/039,936 filed on Aug. 21, 2014, which is hereby incorporated by reference herein and made a part of specification.

BACKGROUND OF THE INVENTION

I. Field of the Invention

The present invention relates to an electrical component using a lead frame, and in particularly, to an inductor using a lead frame.

II. Description of the Prior Art

An integrally-formed inductor is made by encapsulating a conductor wire or a coil with a magnetic body instead of winding the conductor wire around an existing magnetic core. Since an integrally-formed inductor has many advantages, such as smaller volume, lower impedance and the endurance for sustain larger current, it has been widely adopted in electronic products that require smaller size, lower power consumption and higher performance.

A known process of making an integrally-formed inductor with low-inductance is illustrated in FIG. 1, including the steps of: (step 1) preparing a coil (e.g., a straight-line-type coil 11 illustrated in FIG. 1); (step 2) adopting a magnetic powder material and performing a thermal-compression process to form an integrally-formed magnetic body 12 encapsulating the straight-line-type coil 11; (step 3) trimming the excessive straight-line-type coil 11 exposed outside of the magnetic body 12; (step 4) performing an electroplating process on two surfaces of the magnetic body 12 to form electrodes 13 which are electrically connected to the straight-line-type coil 11. Because the integrally-formed inductor has a smaller size and the line width of the straight-line-type coil 11 is usually only 60 μm~70 μm, it is very difficult to fix the straight-line-type coil 11 in the process of forming the integrally-formed inductor; in another aspect, the electrodes 13 formed by the electroplating process can cause instability of the contact resistance, and hence impact the electrical performance of the inductor and reduce the yield rate of the inductor.

Another known process of making an integrally-formed inductor is illustrated in FIG. 2, which includes the steps of; connecting an electrode 14 to the two ends of the straight-line-type coil 11; adopting a magnetic powder material and performing a thermal-compression process to form an integrally-formed magnetic body 12 to encapsulate the straight-line-type coil 11; trimming the electrode 14 according to a design length, bending/modeling the electrode 14 exposed outside the magnetic body 12 so as to adhere the electrode 14 to a lateral surface of the magnetic body 12. Although the structure of the electrode 14 can solve the problem as mentioned in the structure electrode 13 formed by the electroplate process, however, in the structure of the electrode 14, the cross section area of the straight-line-type coil 11 is so small that the joint point 15 between the straight-line-type coil 11 and the electrode 14 will easily rupture from the bending of the electrode 14.

SUMMARY OF THE INVENTION

One objective of present invention is to provide an integrally-formed inductor to solve the abovementioned problem wherein the joint point between the coil and the electrode will easily rupture from the bending of the electrode 14.

The present invention discloses an integrally-formed inductor, wherein the integrally-formed inductor comprises: a metal structure, the metal structure comprising a conductor wire and a lead frame, wherein the lead frame and the conductor wire are integrally formed, wherein the lead frame comprises a first part and a second part spaced apart from the first part, wherein a contiguous metal path is formed from the first part of the lead frame to the second part of the lead frame via the conductor wire; and a magnetic body encapsulating the conductor wire, and a first portion of the first part and a second portion of the second part of the lead frame adjacent to the conductor wire.

In one embodiment, the inductive component is a choke.

In one embodiment, the inductive component the conductor wire is a straight wire.

In one embodiment, the conductor wire is an arc-type coil or curved-line coil.

In one embodiment, the conductor wire is a spiral coil.

In one embodiment, the magnetic body is integrally formed to encapsulate the conductor wire, the first portion of the first part and the second portion of the second part of the lead frame.

In one embodiment, the width of the first portion of the first part of the lead frame is larger than that of the conductive wire for strengthen the mechanical strength between the conductor wire and the first part of the lead frame.

In one embodiment, the width of the second portion of the second part of the lead frame is larger than that of the conductive wire for strengthening the mechanical strength between the conductor wire and the second part of the lead frame.

In one embodiment, the conductor wire is a line-type coil and the width of the line-type coil is 60 μm~70 μm.

In one embodiment, each of the first portion of the first part of the lead frame and the second portion of the second part of the lead frame has a shape in one of the followings: round, rectangle and trapezoid.

In one embodiment, each of the first portion and the second portion has a round-corner in the front surface adjacent to the conductor wire.

In one embodiment, the third portion extending from the first portion of the first part and the fourth portion extending from the second portion of the second part extend outside of the magnetic body and are bent onto two recesses on said two opposite surfaces of the magnetic body for making two electrodes, respectively.

In one embodiment, the outer surface of each electrode aligns with a corresponding surface of the magnetic body on which the electrode is disposed.

In one embodiment, a method to form an inductive component is disclosed, the method comprising: integrally forming a metal structure, the metal structure comprising a conductor wire and a lead frame, wherein the lead frame comprising a first part and a second part spaced apart from the first part, wherein a contiguous metal path is formed from the first part of the lead frame to the second part of the lead frame via the conductor wire; and a magnetic body encapsulating the conductor wire, and a first portion of the first part and a second portion of the second part of the lead frame adjacent to the conductor wire.

In one embodiment, the method further comprising extending the first portion of the first part of the lead frame onto a first surface of the magnetic body to form a first electrode and extending the second portion of the second part of the lead frame onto a second surface opposite to the first surface of the magnetic body to form a second electrode.

In one embodiment, the inductive component is a choke.

In one embodiment, an inductive component is disclosed, comprising: a conductor wire; a lead frame comprising a first part and a second part spaced apart from the first part, two ends of the conductive wire being joined with a first portion of the first part of the lead frame and a second portion of the second part of the lead frame, respectively, wherein the width of each of the first joint portion and the second joint portion is larger than the width of the conductor wire; and a magnetic body, the magnetic body being integrally formed to encapsulate the conductor wire, the first portion of the first part and the second portion of the second part of the lead frame, wherein a third portion extending from the first portion of the first part of the lead frame and a fourth portion extending from the second portion of the second part of the lead frame are bent onto two opposite outer surfaces of the magnetic body to form a first electrode and a second electrode, respectively.

In one embodiment, the inductive component is a choke.

In one embodiment, the conductor wire is a line-type coil.

In one embodiment, the width of line-type coil is 60 μm~70 μm.

Another aspect of the present invention comprises a first integrally-formed inductor and a second integrally-formed inductor, wherein the structure of the first integrally-formed inductor is the same as that of the second integrally-formed inductor.

Another aspect of the present invention comprises a first integrally-formed inductor and a second integrally-formed inductor, wherein the structure of the first integrally-formed inductor is different from that of the second integrally-formed inductor. For an electronic product which needs to use two or more integrally-formed inductors at the same time, the metallic structure used in the first integrally-formed inductor and the second integrally-formed inductor can be integrated together by the lead frame, and the magnetic body of the first integrally-formed inductor and the second integrally-formed inductor can be formed in a single thermal-compression process.

The detailed technology and above preferred embodiments implemented for the present invention are described in the following paragraphs accompanying the appended drawings for people skilled in this field to well appreciate the features of the claimed invention.

BRIEF DESCRIPTION OF THE DRAWINGS

The foregoing aspects and many of the accompanying advantages of this invention will become more readily appreciated as the same becomes better understood by reference to the following detailed description when taken in conjunction with the accompanying drawings, wherein.

DETAIL DESCRIPTION OF THE INVENTION

The detailed explanation of the present invention is described as following. The described preferred embodiments are presented for purposes of illustrations and description and they are not intended to limit the scope of the present invention.

Figure 1:
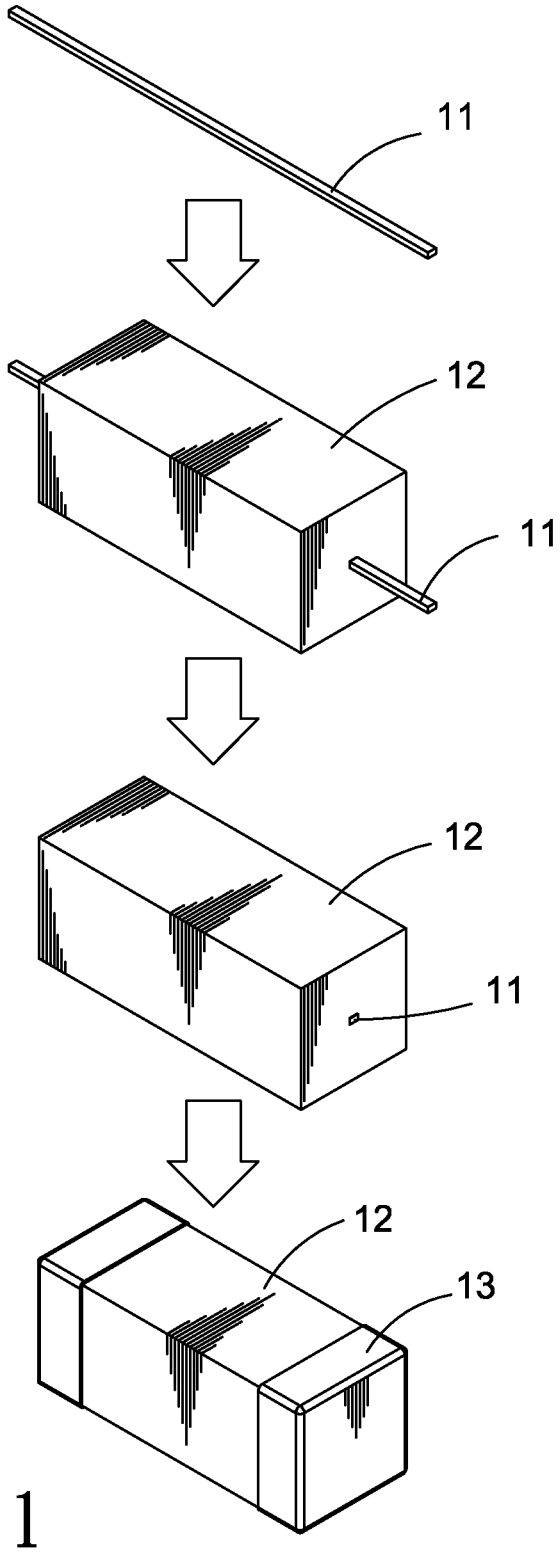
FIG. 1 illustrates a process for a known low-inductance inductor.
Figure 2:
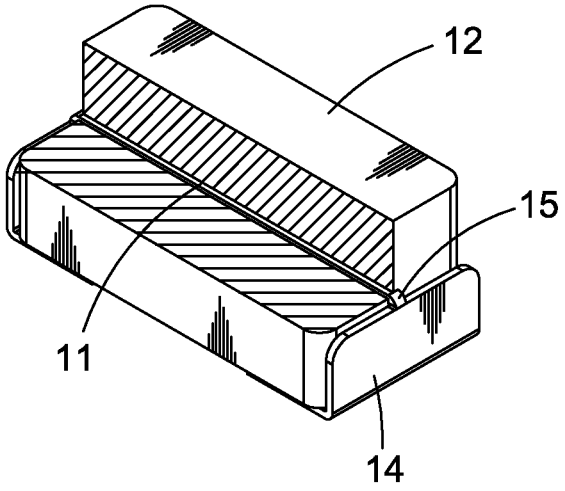
FIG. 2 illustrates a structure of another known integrally-formed inductor.
Figure 3:
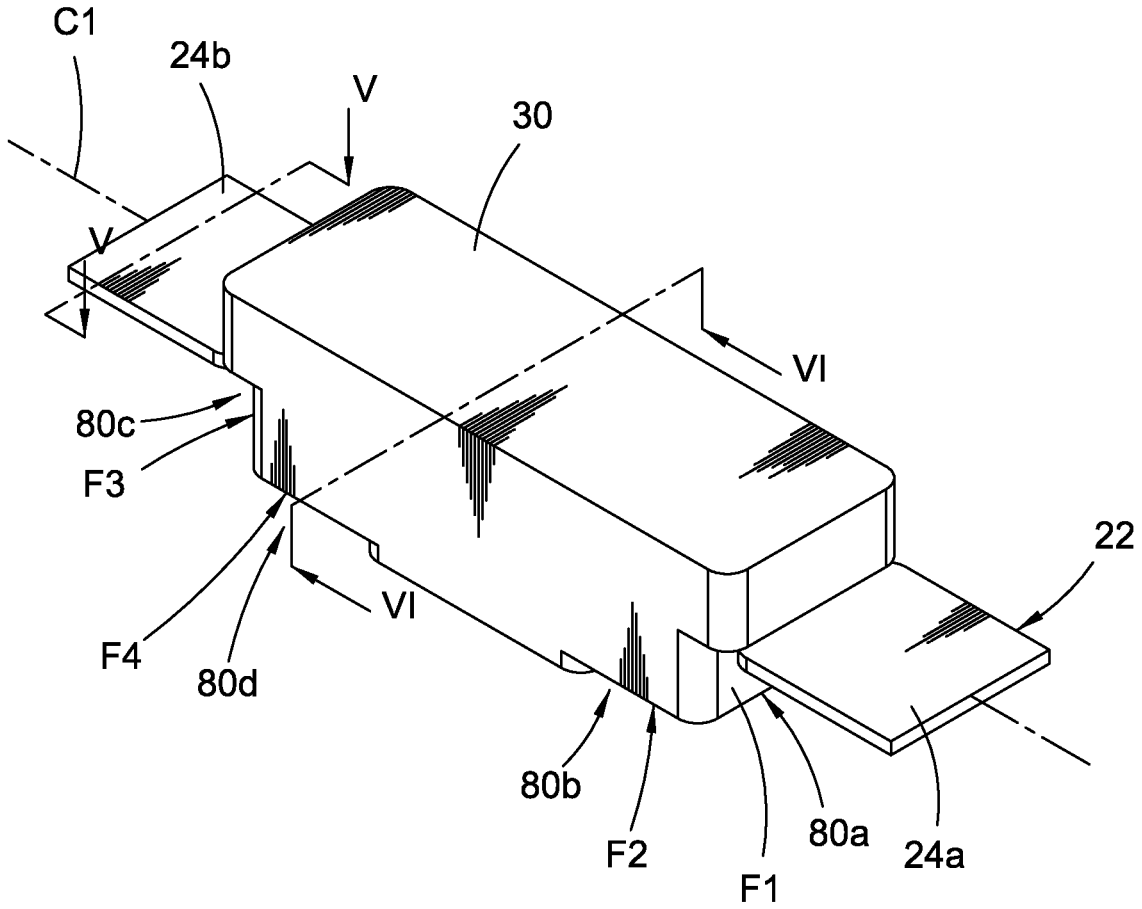
FIG. 3 illustrates an exemplary structure of the integrally-formed inductor in the present invention, wherein the first electrode and the second electrode are not bent.
Figure 4:
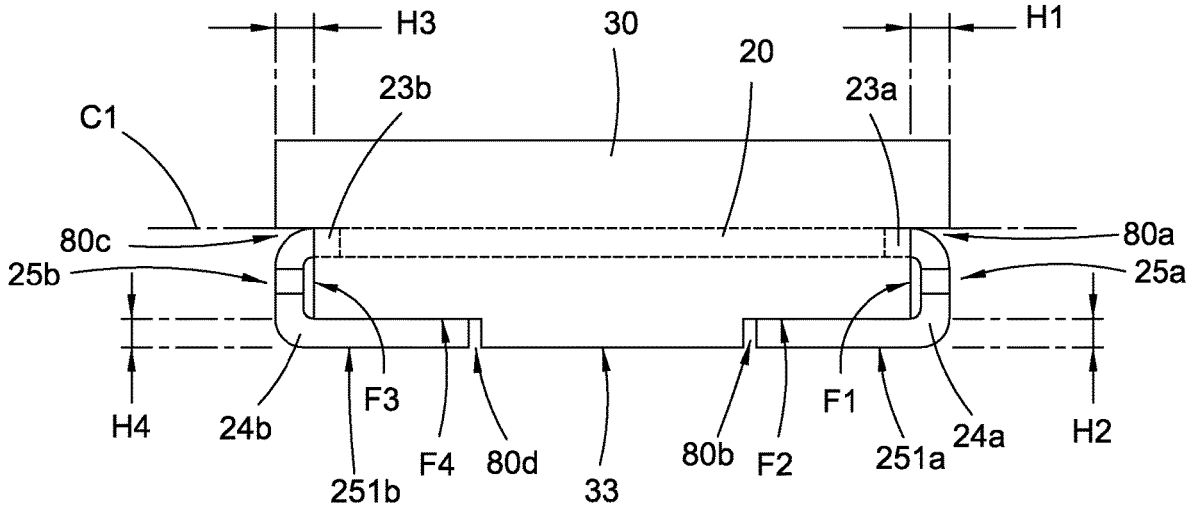
FIG. 4 illustrates a front view of the embodiment in FIG. 3, wherein the locations of the bent portion of the first electrode and the second electrode are shown.
Figure 5:
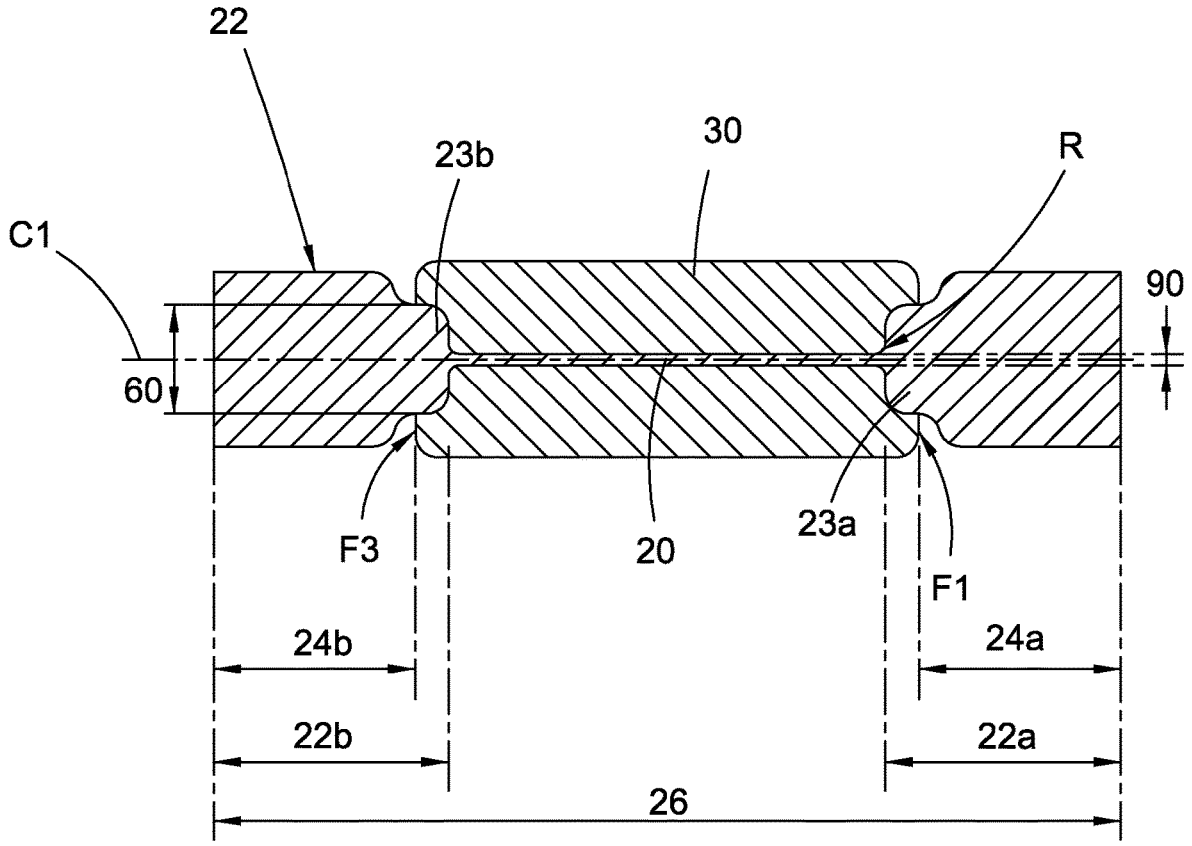
FIG. 5 illustrates a structural cross-sectional view in location V-V of FIG. 3.
Figure 7:
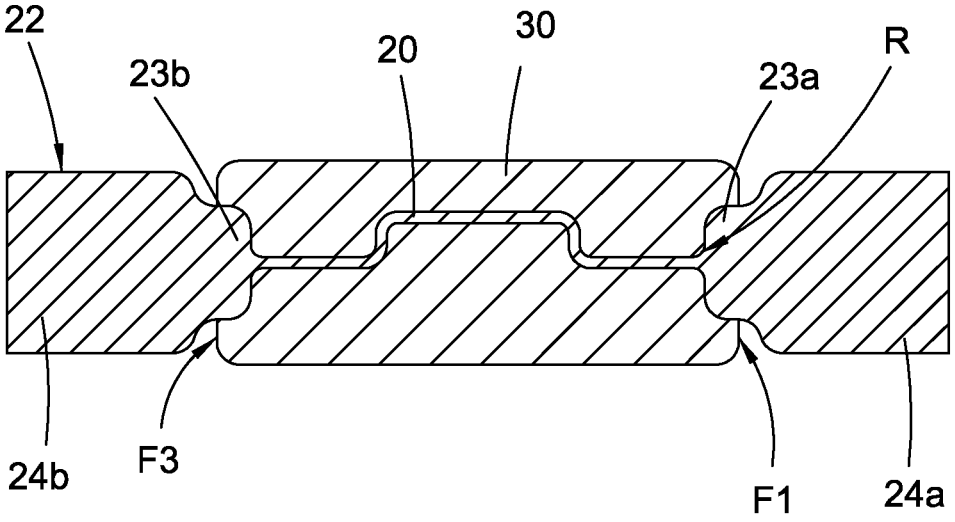
FIG. 7 illustrates a schematic cross-sectional view of another embodiment of the integrally-formed inductor in the present invention, wherein another exemplary structure of the line-type coil is shown.

Please refer to FIG. 3 to FIG. 5, FIG. 3 illustrates an exemplary structure of the integrally-formed inductor in the present invention, the integrally-formed inductor comprises: a metal structure, the metal structure comprising a conductor wire, such as a line-type coil 20, and a lead frame 22, wherein the lead frame 22 and the conductor wire, such as the line-type coil 20, are integrally formed, wherein the lead frame 22 comprises a first part 22*a* and a second part 22*b* spaced apart from the first part 22*a*, wherein a contiguous metal path 26 is formed from the first part of the lead frame 22*a* to the second part of the lead frame 22*b* via the conductor wire 20; and a magnetic body 30 encapsulating the conductor wire 20, and a first portion 23*a* of the first part 22*a* and a second portion 23*b* of the second part 22*b* of the lead frame 22 adjacent to the conductor wire 20. The first portion 23*a* of the first part 22*a* of the lead frame 22 and the second portion 23*b* of the second part 22*b* of the lead frame 22 are adjacent to the conductor wire 20, and hence the width 60 of each of the first portion 23*a* and the second portion 23*b* is large than the width 90 of the conductor wire 20 for increasing the mechanic strength between them. In one embodiment, a conductor wire 20 is a line-type coil, which can be a straight-line-type coil (see FIG. 5); in another embodiment, the conductor wire 20 can be also an arc-type coil (see FIG. 7). The two ends of the conductor wire 20 are each connected with the first portion 23*a* of the first part 22*a* of the lead frame 22 and the second portion 23*b* of the second part 22*b* of the lead frame 22 (see FIG. 5), wherein the width 60 of the first portion 23*a* is larger than the width of the line-type coil 20 for strengthen the mechanical strength between the conductor wire 20 and the first part 22*a* of the lead frame 22, the width of the second portion 23*b* is larger than the width of the conductor wire 20 for strengthen the mechanical strength between the conductor wire 20 and the second part 22*b* of the lead frame 22. Each of the first portion 23*a* and the second portion 23*b* extends outside of the magnetic body 30 to form a first electrode 25*a* and a second electrode 25*b*, respectively. In one embodiment, the first portion 23*a* and the second portion 23*b* extends in two opposite directions with respect to the first axial direction C1. The first portion 23*a* and the second portion 23*b* can have the same shapes and be symmetric with each other; and the first electrode 25*a* and the second electrode 25*b* can have the same shapes and be symmetric with each other.

In one embodiment, the magnetic body 30 encapsulates the conductor wire 20, the first portion 23*a* and the second portion 23*b* of the lead frame 22. In one embodiment, the conductor wire 20 is mounted in a molding device and the magnetic material powder is filled in the molding device to integrally form the magnetic body 30 by a thermal-compression method. The magnetic body 30 can be in many different shapes, such as cylinder, cuboid, cube and hexagonal column In the embodiment as illustrated in FIG. 3, the magnetic body 30 is a cuboid, but the present invention is not limited this case. The magnetic material powder used to form the magnetic body 30 can be at least one of the followings: of Fe, Fe—Si—Al alloy, Fe—Ni—Mo alloy, Fe—Ni alloy, amorphous alloy and Ferrite. After the magnetic body 30 is formed, the third portion 24*a* of the first part 22*a* of the lead frame 22 and a fourth portion 24*b* of the second part 22*b* of the lead frame extend outside of the magnetic body 30 and then are bent and adhered to two opposite side surfaces of the magnetic body 30 for making two electrodes, respectively (see FIG. 4). Due to fact that that the first portion 23*a* and the second portion 23*b* of the lead frame can respectively increase the mechanic strength between the conductor wire 20 and the first part 22*a* and the mechanic strength between the conductor wire 20 and the second part 22*b*, the rupturing of the conductor wire 20 resulting from the bending of the first electrode 25*a* or the second electrode 25*b* can be avoided.

In one embodiment of the present invention, the shape of each of the first portion 23*a* and the second portion 23*b* has a shape in rectangle or trapezoid. In another embodiment, each of the first portion 23*a* and the second portion 23*b* has a round-corner R adjacent to the conductor wire 20, the rupture of the line-type coil 20 resulting from stress concentration can be avoided through the round-corner R due to the bending of the first electrode 25*a* and the second electrode 25*b*.

Figure 8:
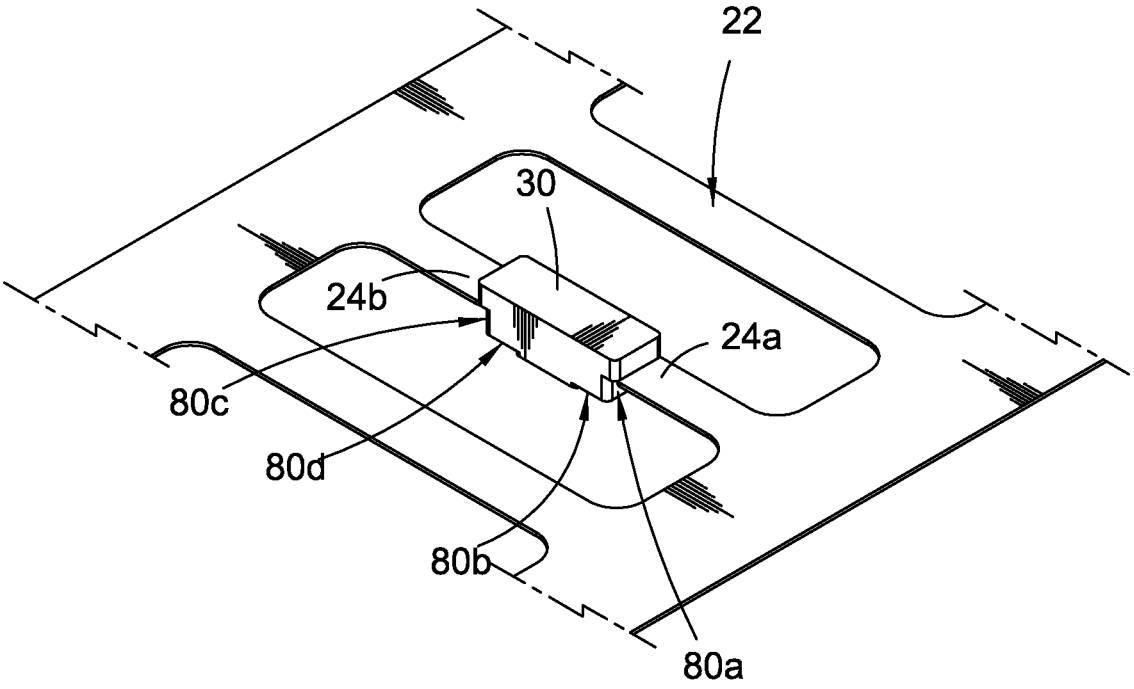
FIG. 8 illustrates another exemplary structure in the present invention.

In another embodiment of the present invention, the integrally-formed inductor comprises a lead frame 22 illustrated in FIG. 8, and the line-type coil 20, the first part 22*a*, the second part 22*b*, the first electrode 25*a* and the second electrode 25*b* and the lead frame 22 are integrated into an integrally-formed structure; because the lead frame 22 can easily fix the position of the conductor wire 20, the first portion 23*a*, the second portion 23*b*, the first electrode 25*a* and the second electrode 25*b* in the molding device when forming the integrally-formed inductor, which solves the known problem that the line-type coil cannot be easily positioned in a process of forming the integrally-formed inductor in the past. In one embodiment of the present invention, after the magnetic body 30 has been formed, the first electrode 25*a* and the second electrode 25*b* connected to the lead frame 22 are trimmed into a predefined length, and then the first electrode 25*a* and the second electrode 25*b* are bent and adhered to two opposite surfaces of the magnetic body 30 so as to form an integrally-formed inductor.

In one embodiment of the present invention, the outer surfaces of the magnetic body 30 have recesses for disposing the third portion 24*a* of the first part 22*a* of the lead frame 22 and a fourth portion 24*b* of the second part 22*b* of the lead frame 22 for making electrodes 25*a*, 25*b*. In one embodiment, the first electrode 25*a* and the second electrode 25*b* can be adhered to the recesses, and the outer surfaces of the first electrode 25*a* and the second electrode 25*b* align with the outer surfaces of magnetic body 30.

As illustrated in FIG. 3 and FIG. 4, in one embodiment of the integrally-formed inductor of the present invention, the magnetic body 30 is a cuboid, wherein the third portion 24*a* of the first part 22*a* of the lead frame 22 and a fourth portion 24*b* of the second part 22*b* of the lead frame extend outside of the magnetic body 30 in two opposite directions with respect to the first axial direction C1 respectively, wherein the first electrode 25*a* is disposed on a first bottom surface F1 of a first recess 80*a* located at a first lateral surface of the magnetic body 30 and a second bottom surface F2 of a second recess 80*b* located at the bottom surface of the magnetic body 30. The first recess has a height H1 and the second recess has a height H2, such that the size of the first electrode 25*a* can be accommodate in the first recess 80*a* and the second recess 80*b*. Likewise, the second electrode 25*b* is disposed on a third bottom surface F3 of a third recess 80*c* located at a second lateral surface opposite to the first lateral surface of the magnetic body 30 and a fourth bottom surface F4 of a fourth recess 80*d* located at the bottom surface of the magnetic body 30. The third recess 80*c* has a height H3 and the fourth recess has a height H4, such that the size of the second electrode 25*b* can be accommodated in the third recess 80*c* and the fourth recess 80*d*. In one embodiment, each of the first electrode 25*a* and the second electrode 25*b* is for mounting on a SMT (Surface-Mount Technology) type pad, but it is not limited to.

Figure 6:
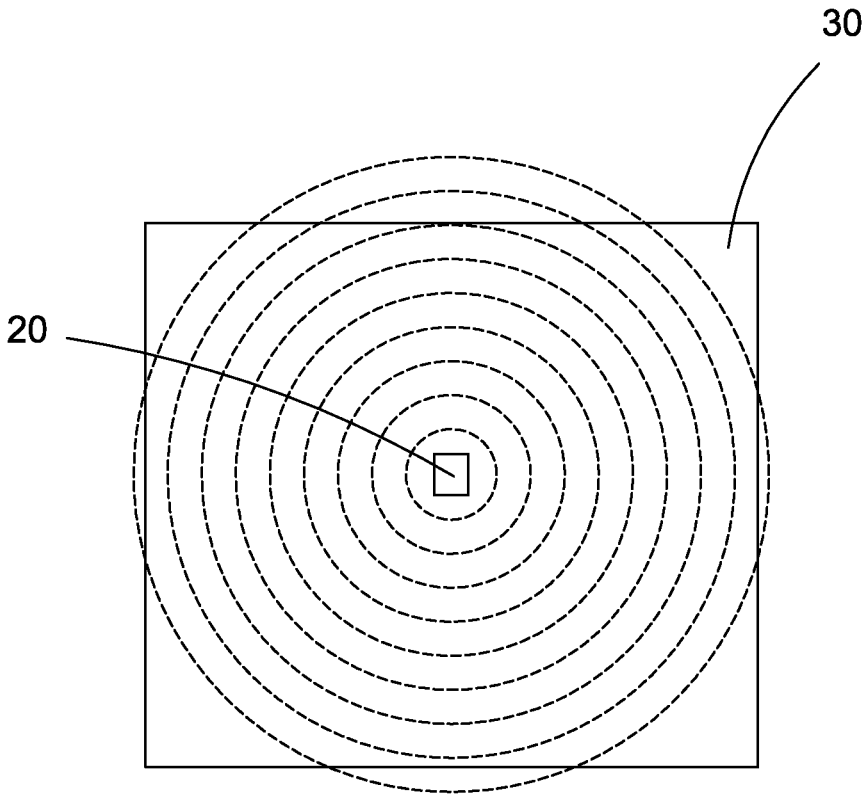
FIG. 6 illustrates a structural cross-sectional view in location VI-VI of FIG. 3.

Please refer to FIG. 6. FIG. 6 illustrates a schematic cross-sectional view of the integrally-formed inductor in one embodiment of the present invention. From FIG. 6, the conductor wire 20 is a straight-line-type coil; the magnetic-field distribution of the magnetic body 30 is illustrated as the dashed lines in FIG. 6, and the inductance and the magnetic flux of the inductor have a positive-correlation relationship. According to the structure illustrated in FIG. 6, with a given size of an integrally-formed inductor, for example, the volume of the magnetic body 30, in FIG. 3 and FIG. 4, is length (L)*width (W)*height (H), the magnetic flux of the magnetic body 30 and the line width, or the line diameter, of the conductor wire 20 have an inverse-proportion relationship.

In one embodiment, the line width, or the line diameter, of the conductor wire 20 is 60 μm~70 μm. Through the structure of the first bottom surface F1 of the first recess 80*a*, the second bottom surface F2 of the second recess 80*b*, the third bottom surface F3 of the third recess 80*c* and the fourth bottom surface F4 of the fourth recess 80*d*, the outer surface 251*a* of the first electrode 25*a* and the outer surface 251*b* of the second electrode 25*b* can be aligned with the outer surfaces of the magnetic body 30, so as to enhance the inductance for a given size of an integrally-formed inductor.

Figure 9:
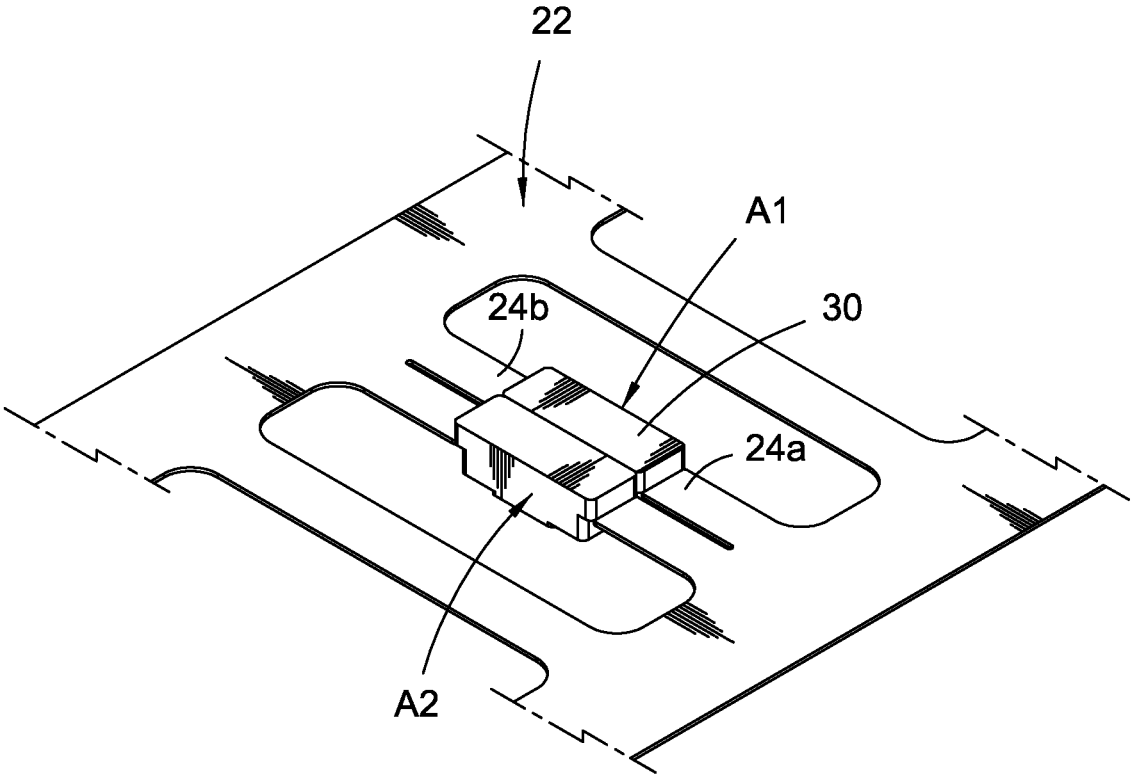
FIG. 9 illustrates another exemplary structure in the present invention.

Please refer to FIG. 9, another aspect of the present invention comprises a first integrally-formed inductor A1 and a second integrally-formed inductor A2. The structure of each of the first integrally-formed inductor A1 and the second integrally-formed inductor A2 can be the same as that of the above integrally-formed inductor illustrated in FIG. 3 to FIG. 5. For an electronic product which needs to use two or more integrally-formed inductors at the same time, the metallic structure used in the first integrally-formed inductor A1 and the second integrally-formed inductor A2 can be integrated together by the lead frame 22; through said metallic structure (e.g., the conductor wire 20, the first portion 23*a*, the second portion 23*b*, the first electrode 25*a* and the second electrode 25*b* in the above-mentioned embodiment), the magnetic body 30 of the first integrally-formed inductor A1 and the second integrally-formed inductor A2 can be formed in a single thermal-compression process.

In another embodiment of the present invention, the inductance of the first integrally-formed inductor A1 is different from that of the second integrally-formed inductor A2. Different inductances can be made in many ways such as by varying the cross sectional area of the conductor wire 20 or by using different magnetic powder material to form a magnetic body of the inductor.

Figure 10A:
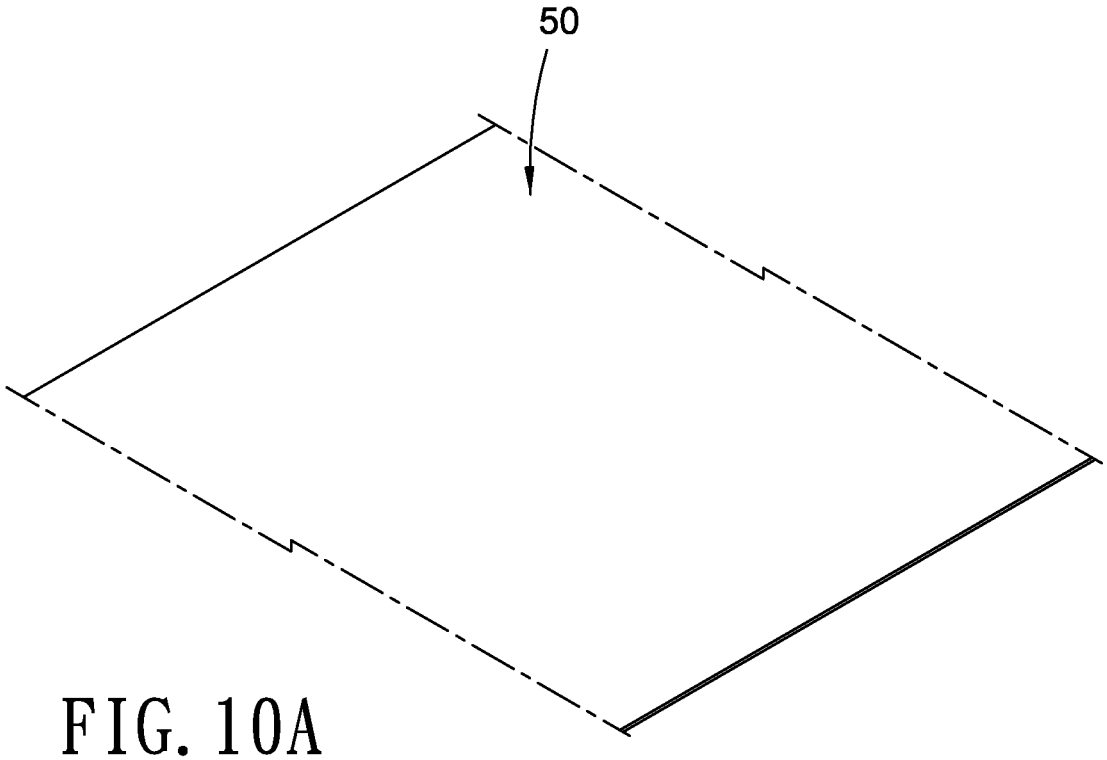
FIG. 10A~10E illustrate a manufacturing process to make an integrally formed inductor as shown in FIG. 3.
Figure 10B:
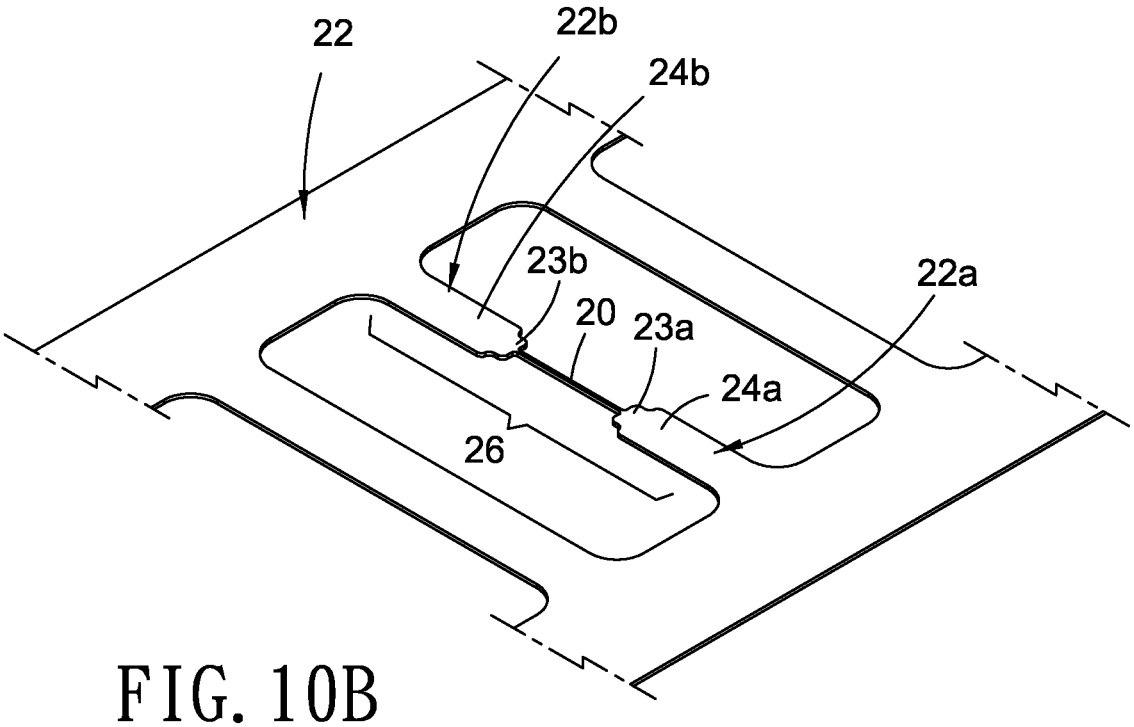
Figure 10C:
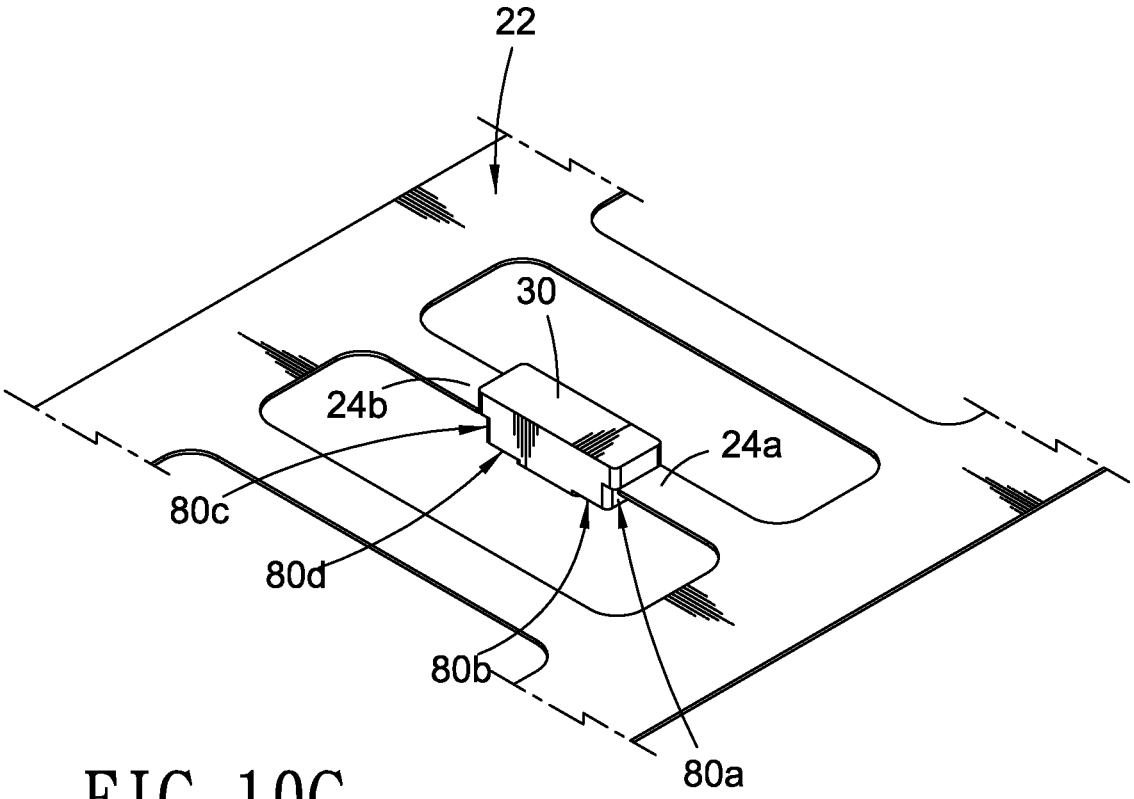
Figure 10D:
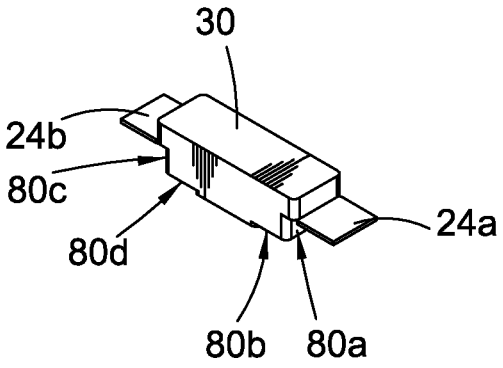
Figure 10E:
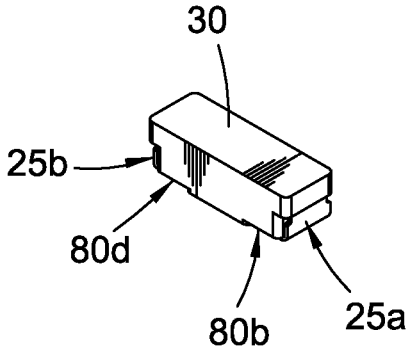

Please refer to FIG. 10A-10E, which illustrate a manufacturing process to make an integrally formed inductor as shown in FIG. 3. Firstly, a metal material 50 is provided as shown in FIG. 10A.Then, performing a molding process to integrally form a metal structure comprising a lead frame 22 with a conductor wire 20 on the metal material 50 as shown in FIG. 10B, wherein the lead frame 22 comprises a first part 22*a* and a second part 22*b* spaced apart from the first part, wherein a contiguous metal path 26 is formed from the first part 22*a* of the lead frame 22 to the second part 22*b* of the lead frame 22 via the conductor wire 20. The molding process to form the metal structure can include a stamping or an etching process. The portions 24*a*, 24*b* of the lead frame 22 can be used for making electrodes. Afterwards, as shown in FIG. 10C, encapsulating the conductor wire 20 and the portions 23*a*, 23*b* adjacent to the conductor wire 20 using magnetic powders to form a magnetic body 30 with the portions 24*a*, 24*b* of the lead frame 22 exposed outside the magnetic body 30 for making electrodes. In one embodiment, the metal structure of the lead frame 22 and the conductor wire 20 is placed in a molding device (not shown) with the portions 24*a*, 24*b* of the lead frame 22 exposed outside the molding device, then filling magnetic powders to encapsulate the lead frame 22 and the conductor wire 20. Afterwards, a pressing process can be performed on the magnetic powders to form the magnetic body 30. Then, performing a cutting process to separate the portions 24*a*, 24*b* of the lead frame 22 from other parts for making electrodes, as shown in FIG. 10D. In one embodiment, as shown in FIG. 10E, the portions 24*a*, 24*b* of the lead frame 22 are bent onto two opposite lateral surfaces of the magnetic body 30 for making electrodes. Due to fact that that the first portion 23*a* and the second portion 23*b* of the lead frame 22 can respectively increase the mechanic strength between the conductor wire 20 and the first part 22*a* of the lead frame 22 and the mechanic strength between the conductor wire 20 and the second part 22*b* of the lead frame 22, the rupturing of the conductor wire 20 resulting from the bending of the electrodes can be avoided.

The above disclosure is related to the detailed technical contents and inventive features thereof. People skilled in this field may proceed with a variety of modifications and replacements based on the disclosures and suggestions of the invention as described without departing from the characteristics thereof Nevertheless, although such modifications and replacements are not fully disclosed in the above descriptions, they have substantially been covered in the following claims as appended.

What is claimed is:

1. An inductive component, comprising:

a unitary metal structure, the unitary metal structure comprising a conductor wire and a lead frame, wherein the conductor wire is a bare metal wire, and the lead frame and the bare metal wire are integrally formed, wherein the lead frame comprises a first part and a second part spaced apart from the first part, wherein a contiguous metal path is formed from the first part of the lead frame to the second part of the lead frame via the bare metal wire; and a magnetic body, encapsulating the bare metal wire, a first portion of the first part of the lead frame adjacent to one end of the bare metal wire, and a first portion of the second part of the lead frame adjacent to the other end of the bare metal wire, wherein a second portion of the first part of the lead frame and a second portion of the second part of the lead frame are exposed outside the magnetic body, wherein said first portion of the first part of the lead frame is embedded inside the magnetic body and has a first width larger than a second width of the bare metal wire, wherein the entire bare metal wire is embedded inside the magnetic body and the outer surface of the bare metal wire is entirely in contact with the magnetic body.

2. The inductive component according to claim 1, wherein the inductive component is a choke.

3. The inductive component according to claim 1, wherein the bare metal wire is a straight wire.

4. The inductive component according to claim 1, wherein the bare metal wire is an arc-type coil or curved-line coil.

5. The inductive component according to claim 1, wherein the magnetic body is integrally formed to encapsulate the bare metal wire, the first portion of the first part of the lead frame and the first portion of the second part of the lead frame.

6. The inductive component according to claim 1, wherein the bare metal wire is a line-type coil and the width of the line-type coil is 60 μm~70 μm.

7. The inductive component according to claim 1, wherein each of the first portion of the first part of the lead frame and the first portion of the second part of the lead frame has a shape in one of the followings: round, rectangle and trapezoid.

8. The inductive component according to the claim 1, wherein each of the first portion of the first part of the lead frame and the first portion of the second part of the lead frame has a round-corner in the front surface adjacent to the bare metal wire.

9. The inductive component according to claim 1, wherein said second portion of the first part extending from the first portion of the first part and said second portion of the second part extending from the first portion of the second part are disposed in two recesses on two opposite surfaces of the magnetic body for making two electrodes, respectively.

10. The inductive component according to claim 9, wherein an outer surface of each electrode aligns with a corresponding surface of the magnetic body on which the electrode is disposed.

11. An inductive component, comprising:

a unitary metal structure, the unitary metal structure comprising a bare metal wire and a lead frame comprising a first part and a second part spaced apart from the first part, wherein the lead frame and the bare metal wire are integrally formed, wherein a contiguous metal path is formed from the first part of the lead frame to the second part of the lead frame via the bare metal wire; and a magnetic body, encapsulating the bare metal wire, a first portion of the first part of the lead frame adjacent to one end of the bare metal wire, and a first portion of the second part of the lead frame adjacent to the other end of the bare metal wire, wherein a second portion of the first part of the lead frame and a second portion of the second part of the lead frame are exposed outside the magnetic body, wherein each of said first portion of the first part of the lead frame and said first portion of the second part of the lead frame is embedded inside the magnetic body and has a first width larger than a second width of the bare metal wire, wherein the entire bare metal wire is embedded inside the magnetic body and the outer surface of the bare metal wire is entirely in contact with the magnetic body.

* * * * *